US006691651B2

(12) United States Patent
Yonekura et al.

(10) Patent No.: US 6,691,651 B2
(45) Date of Patent: Feb. 17, 2004

(54) ENGINE VALVE OPERATING SYSTEM FOR INTERNAL COMBUSTION ENGINE

(75) Inventors: Koichiro Yonekura, Kanagawa (JP); Hidefumi Adachi, Ibaraki (JP); Yoshikazu Hoshi, Ibaraki (JP)

(73) Assignees: Nissan Motor Co., Ltd., Yokohama (JP); Hitachi, Ltd., Tokyo (JP)

( * ) Notice: Subject to any disclaimer, the term of this patent is extended or adjusted under 35 U.S.C. 154(b) by 0 days.

(21) Appl. No.: 09/814,689

(22) Filed: Mar. 15, 2001

(65) Prior Publication Data

US 2001/0032603 A1 Oct. 25, 2001

(30) Foreign Application Priority Data

Apr. 18, 2000 (JP) ..... 2000-116966

(51) Int. Cl.[7] ..... F01L 9/04
(52) U.S. Cl. ..... 123/90.11; 251/129.01
(58) Field of Search ..... 123/90.11; 251/129.1, 251/129.15, 129.16

(56) References Cited

U.S. PATENT DOCUMENTS 5,080,323 A * 1/1992 Kreuter ..... 123/90.11
5,799,926 A * 9/1998 Moriya et al. ..... 123/90.11

FOREIGN PATENT DOCUMENTS

| | | |
|---|---|---|
| JP | 59-213913 | 12/1984 |
| JP | 61-247807 | 11/1986 |

* cited by examiner

*Primary Examiner*—Thomas Denion
*Assistant Examiner*—Jaime Corrigan
(74) *Attorney, Agent, or Firm*—Foley & Lardner

(57) ABSTRACT

An engine valve operating system of an electromagnetic type is arranged to locate a movable member between two electromagnets through a distance block and to connect the two electromagnets through side walls. By alternately energizing the electromagnets, the movable member is reciprocated against spring forces of two springs. An engine valve is interlocked with the movable member and operates according to the reciprocal movement of the movable member. The side wall and/or distance block is made of soft magnetic material and forms a magnetic circuit penetrating a side surface of the movable plate. This new magnetic circuit increases the attracting force of the electromagnet when a clearance between the movable member and the electromagnet is greater than a predetermined clearance. This arrangement decreases energy consumption for the initializing operation of the valve operating system from a neutral position between the electromagnets.

15 Claims, 10 Drawing Sheets

ENGINE VALVE OPERATING SYSTEM FOR INTERNAL COMBUSTION ENGINE

BACKGROUND OF THE INVENTION

The present invention relates to an engine valve operating system for an internal combustion engine, and more particularly to an engine valve operating system which operates engine valves of an internal combustion engine by means of an electromagnetic force generated by alternately energizing two electromagnets.

Various electromagnetic valve operating systems for operating engine valves have been proposed. Generally such electromagnetic valve operating systems require larger electric energy in an initializing operation for starting the valve operation as compared with the electric energy required during a valve operating period. A Japanese Patent Provisional Publication No. 59-213913 discloses an initialization method which largely improves the energy consumption necessary for executing the initializing operation of the engine valve.

SUMMARY OF THE INVENTION

However, this initialization method is required to further certainly execute the initializing operation even if the electromagnet type valve operating system employing this method is put in any condition.

It is therefore an object of the present invention to provide an engine valve operating system which is arranged to increase the attracting force of electromagnets and decrease the energy consumption during the initializing operation.

An engine valve operating system according to the present invention is for an internal combustion engine and comprises a movable member, first and second electromagnets, first and second springs, and a magnetic-circuit member. The movable member interlocks with an engine valve of the engine. The first electromagnet moves the movable member in a valve opening direction when the first electromagnet is energized. The second electromagnet moves the movable member in a valve closing direction when the second electromagnet is energized. The first spring is installed to the engine valve and applies a force directing in the valve opening direction to the movable member. The second spring is installed to said movable member and applies a force directing in the valve closing direction to the movable member. The magnetic-circuit member is connected to the first electromagnet and the second electromagnet. The magnetic-circuit member is made of soft magnetic material. The magnetic-circuit member and one of the first and second electromagnets forms a magnetic circuit when a clearance between the movable member and the one of the first and second electromagnets is within a predetermined range. The magnetic circuit passes magnetic flux from the movable member to the magnetic-circuit member.

DETAILED DESCRIPTION OF THE INVENTION

Referring to FIGS. 1A to 6, there is shown a first embodiment of an engine valve operating system for an internal combustion engine in accordance with the present invention.

Figure 1A:
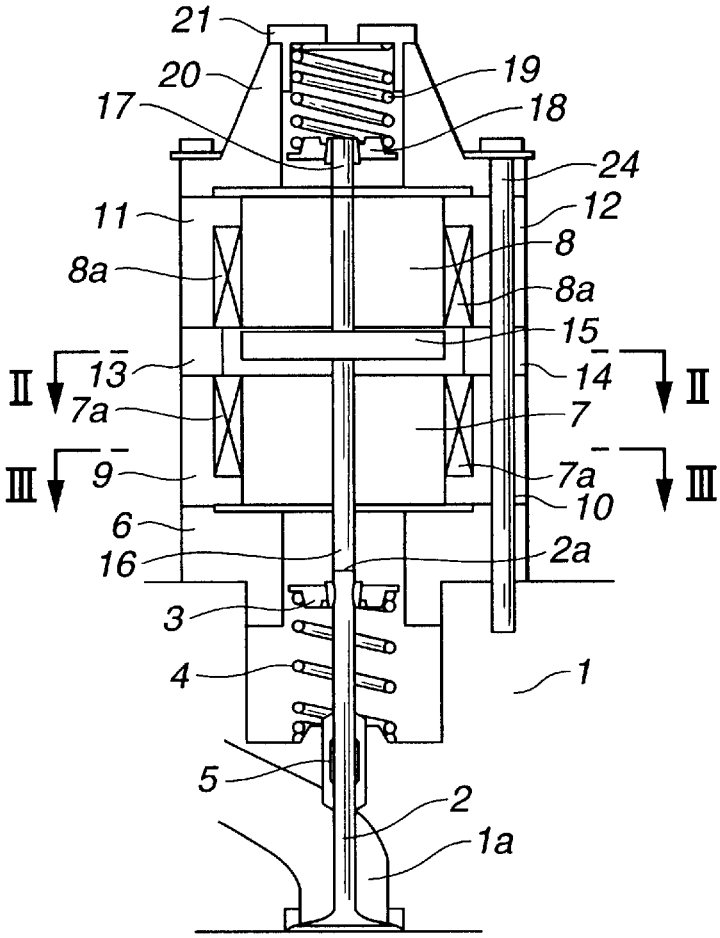
FIG. 1A is a cross sectional view of an engine valve operating system according to a first embodiment of the present invention.
Figure 1B:
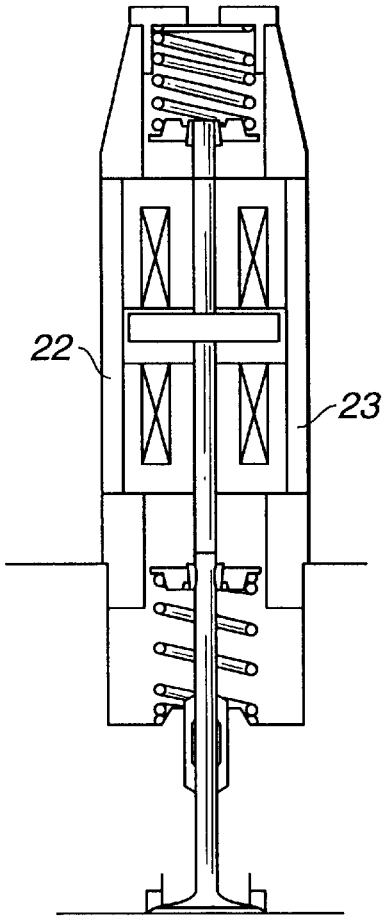
FIG. 1B is another cross sectional view of the engine valve operating system of FIG. 1A.

As shown in FIGS. 1A and 1B, a valve 2 for intake valve or exhaust valve is installed to an intake or exhaust port 1*a* of a cylinder head 1 of the engine. Valve 2 is slidably installed to cylinder head 1 through a guide 5 embedded in cylinder head 1. A retainer 3 for receiving an end of a valve spring 4 is provided at an upper portion of valve 2. Valve spring 4 is provided between retainer 3 and cylinder head 1 while being biased in a compressed condition. Valve spring 4 biases valve 2 toward a direction for closing the port 1*a*.

A bottom piece 6 functioning as a base of a valve drive mechanism is installed to cylinder head 2 so that a lower half portion of bottom piece 6 is embedded in cylinder head 2. An electromagnet 7 for opening valve 2 during an energized condition is installed on the bottom piece 6.

Electromagnet 7 is produced by winding an electromagnetic coil 7*a* to grooves of a core having a E-shaped cross section and by fixedly installing end blocks 9 and 10 to both ends of electromagnetic coil 7*a*. A shaft 16 penetrates a center portion of electromagnet 7 and is slidable with respect to electromagnet 7. A movable plate 15 is fixed to an upper end of shaft 16 and is made of soft magnetic material such as iron. A lower end portion of shaft 16 is in contact with a tope end 2*a* of a stem of valve 2 as shown in FIG. 1A so that movable plate 15 can interlock with valve 2.

An electromagnet 8 for closing valve 2 during an energized condition is installed opposite to electromagnet 7 through movable plate 15. The structure of electromagnet 8 for closing valve 2 is constituted by an electromagnetic coil 8*a* and end blocks 11 and 12. The structure is basically the same as that of electromagnet 7 for opening valve 2 except that electromagnet 8 for opening valve 2 is inversely arranged with respect to a horizontal plane perpendicular to an axis of shaft 16 as compared with electromagnet 7 for closing valve 2. Electromagnets 7 and 8 are fixed to have a predetermined clearance therebetween by providing distance blocks 13 and 14 therebetween while movably locating movable plate 15 in the predetermined clearance.

An upper spring shaft 17 penetrates a center portion of electromagnet 8 and is slidable with respect to electromagnet 8. An upper surface of movable plate 15 is connected to a lower end of upper spring shaft 17, and an upper-spring retainer 18 is fixedly installed to an upper end portion of upper spring shaft 17. A top piece 20 of a body part of the valve operating system receives an end of an upper spring 19 through a spring receiver 21. Upper spring 19 for opening valve 2 is disposed between upper-spring retainer 18 and spring receiver 21 while being put in a compressed condition.

When both electromagnets 7 and 8 are put in deenergized condition, movable plate 15 is kept at a neutral position between both electromagnets 7 and 8 due to valve spring 4 and upper spring 19. Further, when electromagnet 7 for opening valve 2 is energized, electromagnet 7 attracts movable plate 15 in the valve opening direction against the spring force of valve spring 4 to open valve 2. When electromagnet 8 for closing valve 2 is energized, electromagnet 8 attracts movable plate 15 in the valve closing direction against the spring force of upper spring 19 to close valve 2.

Bolts 24 penetrate top piece 20, eng block 12 fixed to electromagnet 8, distance plate 14, end block 10 fixed to electromagnet 7 and bottom piece 6, and fixedly connect these elements to cylinder head 1.

Side walls 22 and 23 are made of soft magnetic material such as iron, and are installed to side surfaces of the E-shaped cores of the respective electromagnets 7 and 8 while ensuring a predetermined clearance with respect to the side surfaces of movable plate 15, as is clearly shown in FIG. 1B.

Figure 2:
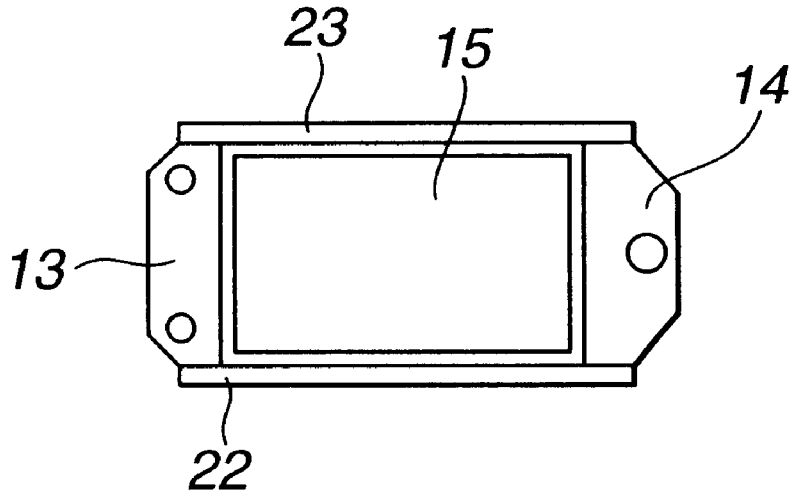
FIG. 2 is a cross sectional view taken in the direction of the arrows substantially along the line II—II of FIG. 1A.
Figure 3:
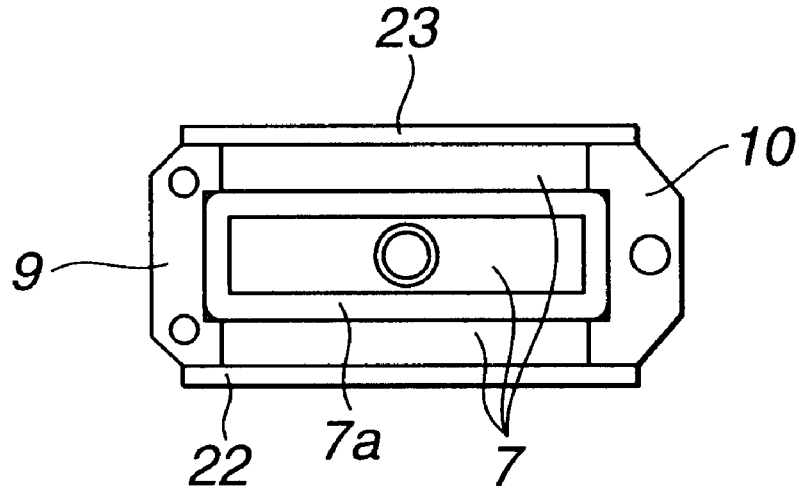
FIG. 3 is a cross sectional view taken in the direction of the arrows substantially along the line III—III of FIG. 1A.

Movable plate 15 and electromagnets 7 and 8 are formed into a rectangular shape, respectively, as viewed from an upper side and as shown in FIGS. 2 and 3. The longitudinal direction of the rectangular of these elements 15, 7 and 8 is the same as a perpendicular direction perpendicular to an axial direction of a crankshaft of the engine. Therefore, distance blocks 13 and 14 are oppositely disposed to face to both short sides of movable plate 15 as shown in FIGS. 1A and 2, and therefore, distance blocks 13 and 14 are disposed along the perpendicular direction with respect to the crankshaft when the valve system is installed to the engine.

Next, there will be discussed the manner of operation of the engine valve operating system according to the present invention.

Figure 4:
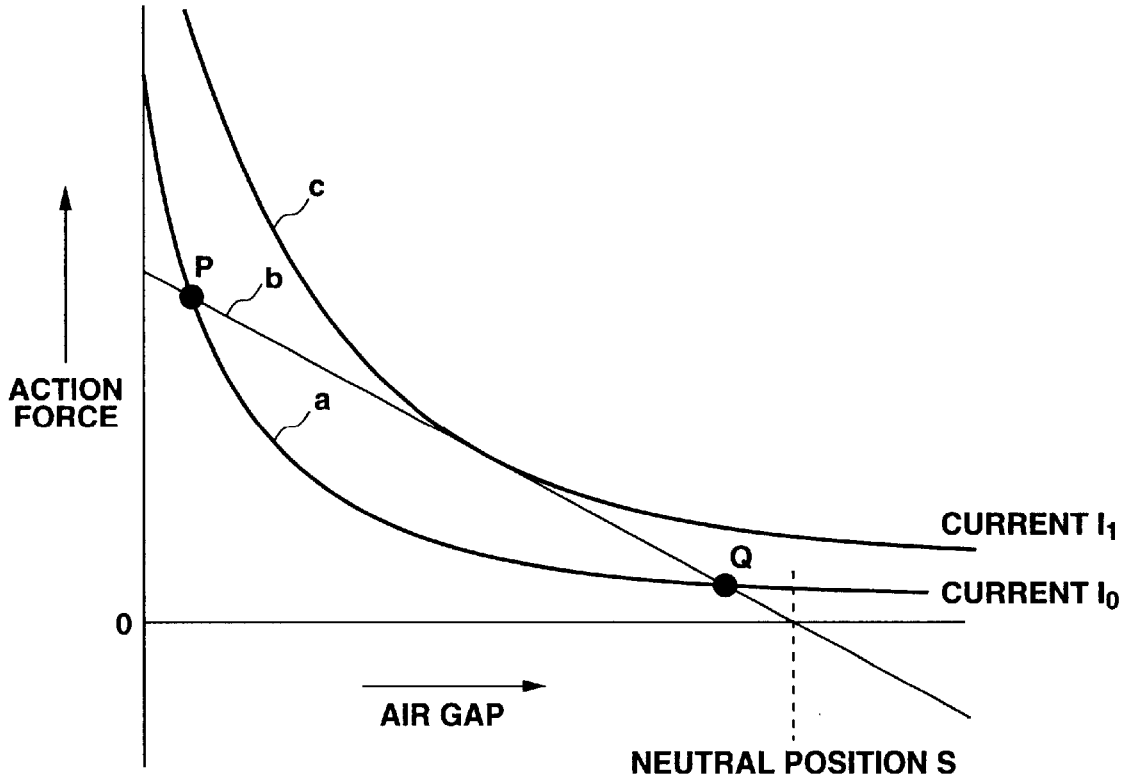
FIG. 4 is a graph showing a relationship of an attracting force of an electromagnet and a spring force with respect to air gap between a movable plate and an electromagnet.

FIG. 4 shows characteristics of electromagnet 7, 8 of a plate type and the spring employed in this embodiment. More specifically, FIG. 4 shows a relationship between an attracting force of electromagnet 7, 8 to movable plate 15 and an air gap between electromagnet 7, 8 and movable plate 15 and a relationship between a spring force of the spring and the air gap under a condition that a predetermined electric current $I_0$ is applied to electromagnet 7, 8. Curve a of FIG. 4 shows the attracting force of electromagnet 7, 8 with respect to the air gap, and curve b of FIG. 4 shows the spring force of the spring with respect to the air gap.

As is clearly shown in FIG. 4, electromagnet 7, 8 generates a large attracting force when the air gap, which is a distance between movable plate 14 and the surface of electromagnet 7 or 8, is very small. Further, when the air gap is relatively large, the attracting force radically decreases. Therefore, the attracting force of the electromagnet 7, 8 under current $I_0$ is balanced with the spring having a composite spring constant k which is a resultant constant of upper spring 19 and valve spring 4, at two balancing points P and Q. The balancing pointy P is an unstable balancing point, and therefore if the position of movable plate 15 shifts any quantity from the point P, the composite force of the attracting force and the spring force acts to increase the shifted quantity with respect to the point P. In contrast to this, the balancing point Q is a stable balancing point, and therefore even if the position of movable plate 15 shifts from the point Q by a predetermined quantity, the composite force acts to return the movable plate 15 to the point Q.

Accordingly, the attracting force of electromagnet 7, 8 becomes greater than the spring force when one of electromagnets 7 and 8 is switched off during normal operation and when movable plate 15 is moved by simple harmonic motion to a position which is nearer than the point P with respect to the other of electromagnets 7 and 8. Therefore, the valve operating system (valve actuator) can attract the movable plate 15 under this condition.

On the other hand, when the initialization of the actuator is started, movable plate 15 first stays at the neutral position S. Under this condition, even if an electric current $I_0$ is applied to one of electromagnets 7 and 8, movable plate 15 merely moves to at most the point Q. Since the point Q is the stable balancing point, even if movable plate 15 is further moved near the electromagnet, movable plate 15 is returned to the point Q by the spring force larger than the attracting force of the electromagnet.

In order to achieve the initialization of the valve operating system, it is necessary that movable plate 15 is put in the attracted condition where movable plate 15 is attracted to electromagnet 7 or 8. That is, it is necessary to apply an electric current $I_1$ larger than the electric current $I_0$ to the electromagnetic coil. Although the current $I_0$ is sufficiently large to execute the normal valve opening and closing operation, the initialization requires the current $I_1$ larger than the current $I_0$. Therefore, it is necessary to provide a power source and a drive circuit for supplying such electric current $I_1$, if the valve operating system is constructed conventionally without side walls 22 and 23 of soft magnetic material.

As mentioned above, the engine valve operating system for operating valve 2 in accordance with the present invention comprises side walls 22 and 23. Accordingly, the engine valve operating system having side walls 22 and 23 ensures the following advantages.

Figure 5:
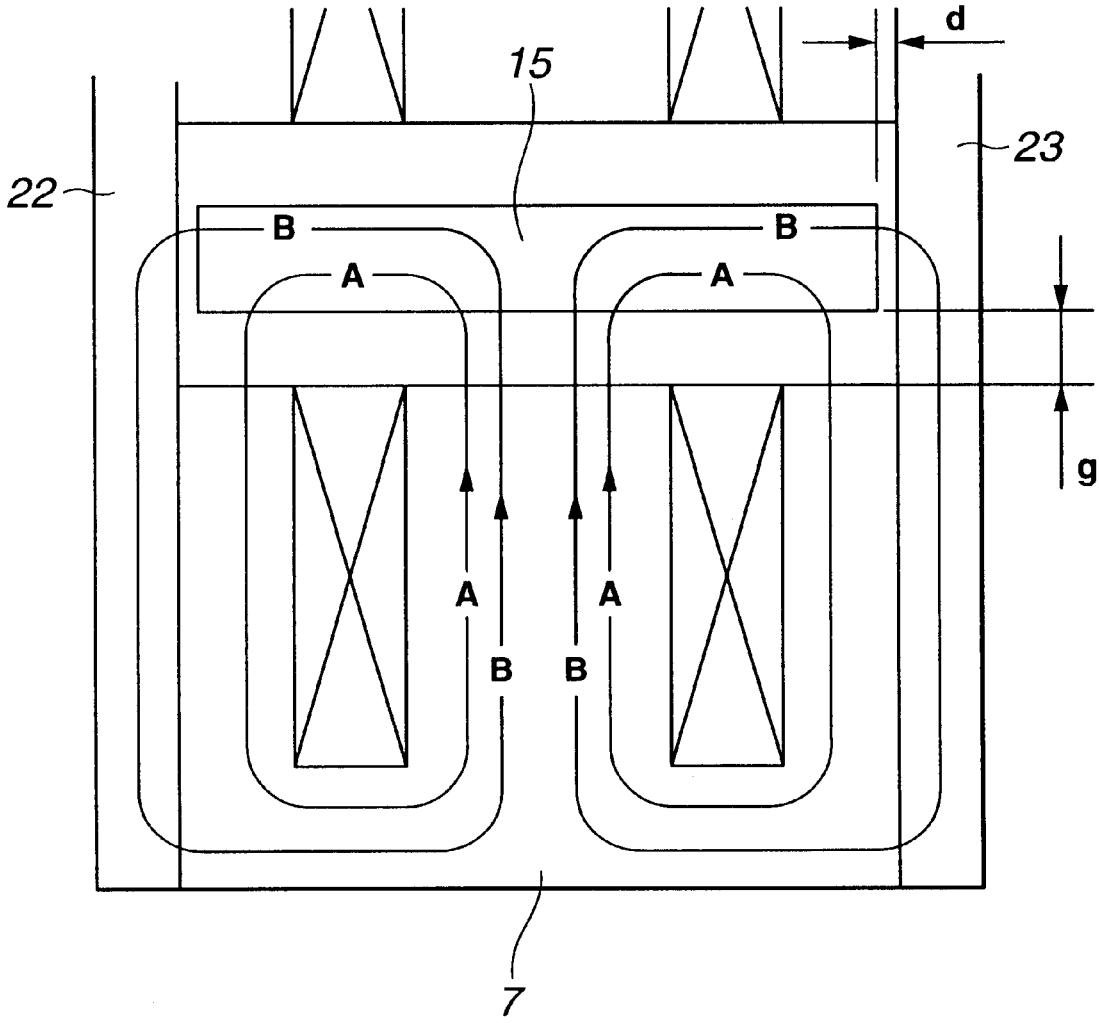
FIG. 5 is an enlarged cross sectional view for explaining a magnetic circuit generated by the electromagnet, the movable plate, and side walls.

The attracting force characteristic of the electromagnet 7 shown by the curve a in FIG. 4 is ensured by the magnetic circuit shown by A in FIG. 5.

By installing side walls 22 and 23 of soft magnetic material at side surfaces of the plate type electromagnet 7 having an E-shaped cross-section, a new magnetic circuit of magnetic flux is generated as shown by arrows B in FIG. 5 when a distance between electromagnet 7, 8 and movable plate 15 is greater than a first predetermined distance. The magnetic circuit shown by the arrow B circulates in the order of the inner magnetic pole of electromagnet 7, air gap, a lower surface of movable plate 15, a side surface of the movable plate 15, side wall 22 or 23 and the outer side of electromagnet 7.

The reason for generating the new magnetic circuit B is that when the distance between movable plate 15 and electromagnet 7 is relatively large, the magnetic resistance of the magnetic circuit B becomes smaller than that of the magnetic circuit A. On the other hand, when movable plate 15 sufficiently approaches electromagnet 7, the magnetic resistance of the magnetic circuit A becomes smaller than a second predetermined distance. Therefore, when the air gap between movable plate 15 and electromagnet is zero or sufficiently small, the magnetic circuit A generates the attracting force as same as the attracting force a of the normal plate type electromagnet.

Figure 6:
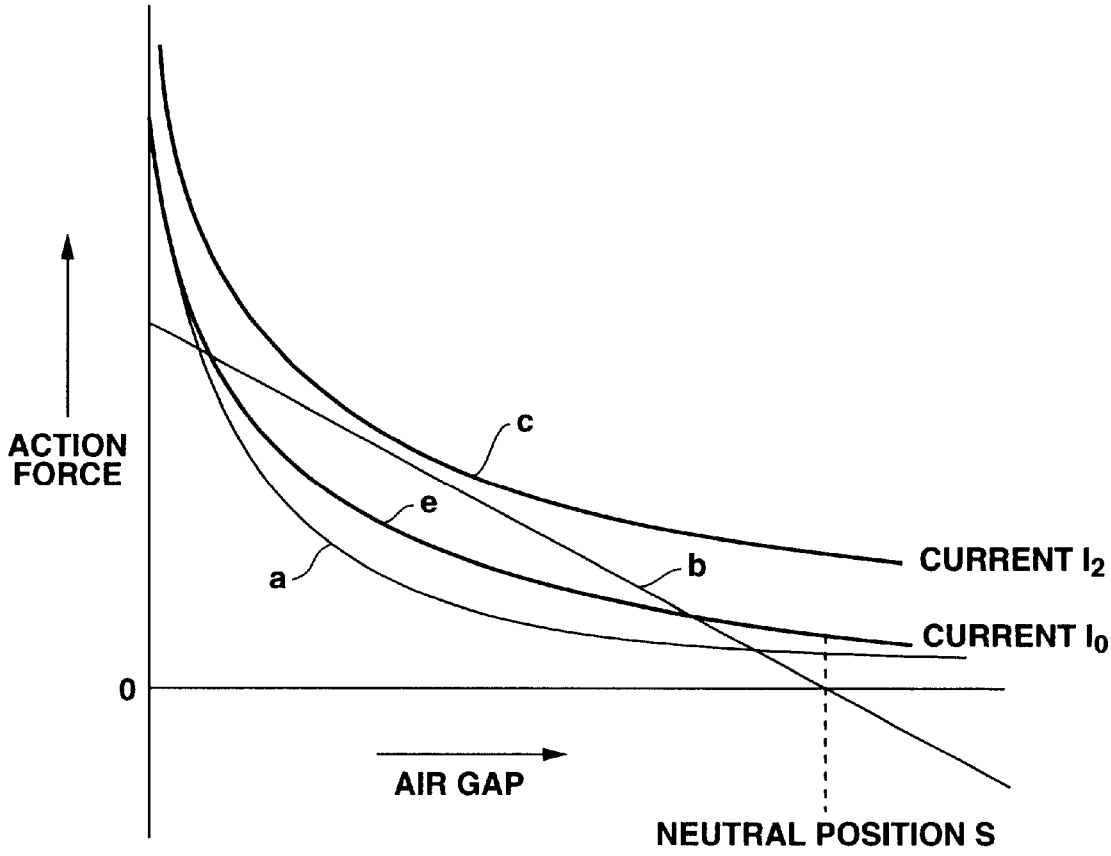
FIG. 6 is a graph showing an advantage of the first embodiment according to the present invention.

Due to the function of the magnetic flux B, the attracting force of electromagnet performs the attracting force shown by curve e in FIG. 6 so as to become larger than the attracting force of a normal plate type without side walls 22 and 23, in the relatively large gap region. More specifically, the function of the first embodiment according to the present invention is explained as follows:

First, it is considered as to a case that no side wall 22, 23 is provided to the actuator. When no side wall 22, 23 is provided, only the magnetic circuit A shown in FIG. 5 is generated under that condition that there is no leakage of magnetic flux and the dispersion of the magnetic flux is equivalent in the magnetic-circuit cross section and the saturation of magnetic field of material is neglected. When the air gap is g, the magnetomotive force NI and the magnetic field Hg in the air gap have a relationship represented by the following equation (1).

$$NI \cong 2H_g \cdot g \tag{1}$$

The equation (1) shows that almost of magnetomotive force NI of electromagnet coil 7*a* generates the magnetic field at the air gap.

By utilizing the equation (1), the attracting force F1 applied to movable plate 15 is represented by the following equation (2):

$$\begin{aligned} F_1 &= 2KB_g^2 S_a \\ &= 2\mu_0^2 K H_g^2 S_a \\ &\cong \frac{1}{4}\mu_0 (NI)^2 \frac{S_a}{g^2} \end{aligned} \tag{2}$$

In this equation (2), $\mu_0$ is the permeability in vacuum space, K is a proportion constant ($K=1/(2\mu_0)$), Bg is a magnetic flux density at the air gap, and Sa is an inner magnetic pole area of electromagnet 7. Similarly, an outer magnetic pole area of electromagnet 7 is Sa.

On the other hand, in case that there are provided side walls 22 and 23, the magnetic circuit B is formed as shown in FIG. 5. Therefore, when a clearance between movable plate 15 and side walls 22 and 23 is d, the magnetomotive force NI and the magnetic field Hg in air gap have a relationship shown by the following equation (1)'

$$NI \cong 2H_g \cdot g + H_d \cdot d \tag{1}'$$

In this equation (1)', Hd is a magnetic field at a clearance.

By utilizing the equation (1)', the attracting force F2 in case of providing side walls 22 and 23 is represented by the following equation (2)':

$$F_2 = KB_g^2 S_a \tag{2}'$$

-continued $$\begin{aligned} &= \mu_0^2 K H_g^2 S_a \\ &\cong \frac{1}{2}\mu_0 (NI - H_d d)^2 \frac{S_a}{g^2}, \end{aligned}$$

By comparing the equation (2) and the equation (2)', it becomes clear that the attracting force in the case of providing side walls 22 and 23 gradually approaches twice the attracting force in the case of no side wall 22 and 23 as the clearance d between the movable plate 15 and side wall 22, 23 sufficiently decreases.

The initializing operation for attracting movable plate 15 from the neutral position S requires the large attracting force under the condition that the air gap is large. Therefore, by providing side walls 22 and 23 in contact with electromagnet 7, 8, the initializing operation can be executed by the electric current $I_2$ smaller than the electric current $I_1$ required when the actuator having no side wall starts the initializing operation. Accordingly, this arrangement is capable of decreasing the energy consumption of electromagnets 7 and 8, of decreasing the size of electromagnets 7 and 8 by decreasing the diameter of wire employed in electromagnetic coil, and of employing small and inexpensive drive circuits by decreasing the current capacity of electromagnet drive circuit or electric wires.

Figure 7A:
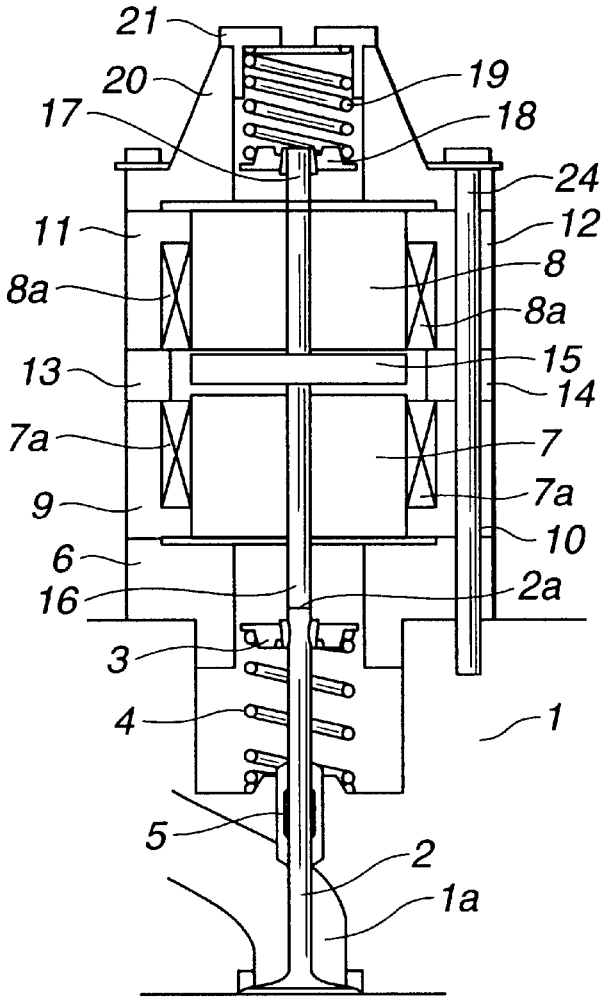
FIG. 7A is a cross sectional view of an engine valve operating system according to a second embodiment of the present invention.
Figure 7B:
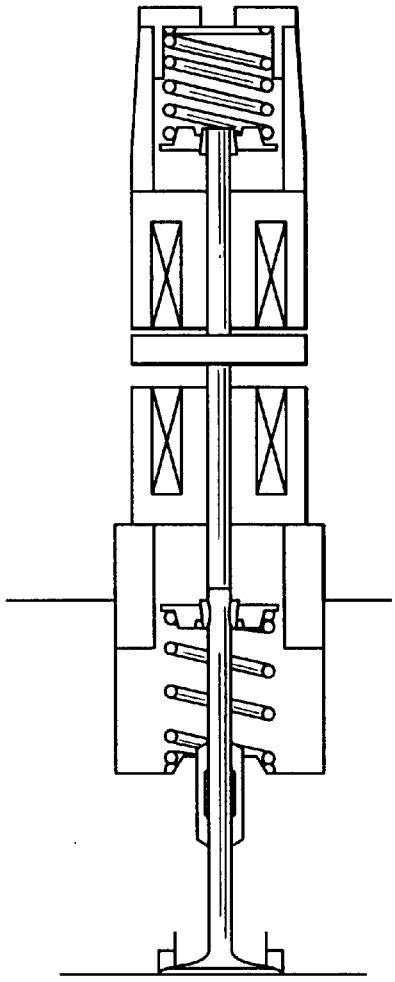
FIG. 7B is another cross sectional view of the engine valve operating system of FIG. 7A.
Figure 8A:
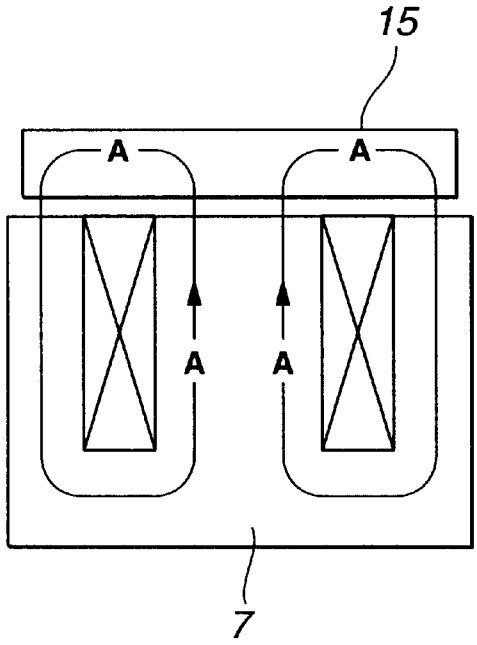
FIG. 8A is a cross sectional view showing a magnetic circuit generated when the movable plate is located near the electromagnet in the second embodiment.

Referring to FIGS. 7A to 8, there is shown a second embodiment of the engine valve operating system according to the present invention.

As shown FIGS. 7A and 7B, the engine valve operating system of the second embodiment is different from the first embodiment in that end blocks 9 and 10 for fixing electromagnet 7, end blocks 11 and 12 for electromagnet 8, and distance blocks 13 and 14 for forming a space between electromagnets 7 and 8 are made of soft magnetic material such as iron, instead of employing side walls 22 and 23. That is, the second embodiment does not employ side walls 22 and 23. The other construction of the engine valve operating system of the second embodiment is the same as that of the first embodiment. The shapes of movable plate 15, electromagnets 7 and 8 and distance blocks 13 and 14 are basically the same as those shown in FIGS. 2 and 3.

In this second embodiment, when movable plate 15 sufficiently approaches electromagnet 7, 8, the attracting force applied to movable plate 15 becomes the same as that formed by the magnetic circuit A in the first embodiment.

Figure 8B:
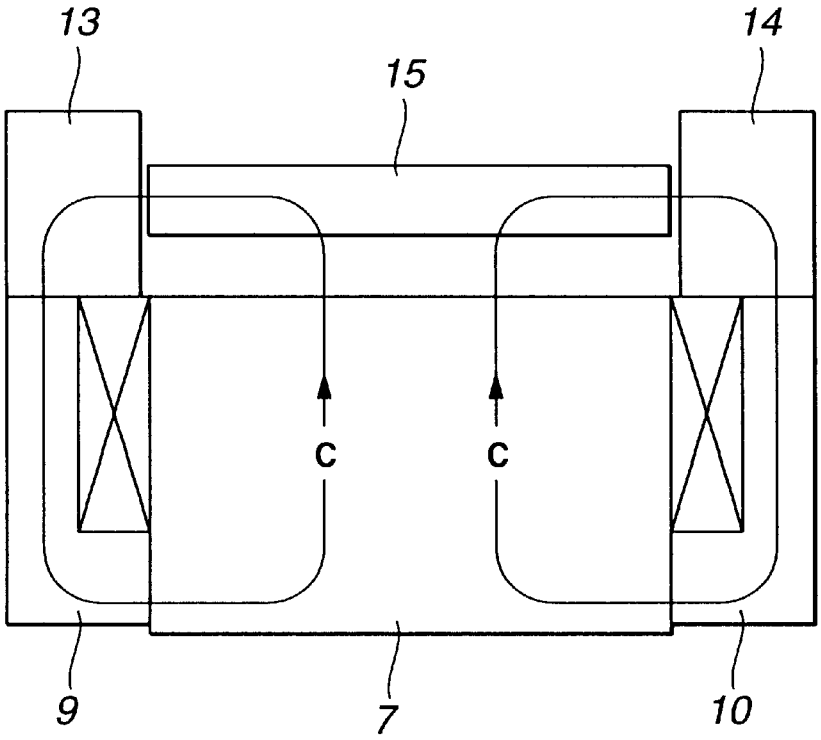
FIG. 8B is another cross sectional view showing a magnetic circuit according to the present invention when the movable plate is apart from the electromagnet.

On the other hand, when movable plate 15 is relatively apart from electromagnet 7, 8, a magnetic circuit is generated as shown by arrows C in FIG. 8B. The magnetic circuit shown by the arrow C circulates in the order of the inner magnetic pole of electromagnet 7, the air gap, a lower surface of movable plate 15, a side surface of the movable plate 15, distance block 13 (14), end block 9 (10, 11, 12) and the outer side of electromagnet 7. The magnetic circuit C is formed around a center axis of movable plate 15 so as to direct from electromagnet 7 to movable plate 15 through inside and direct from movable plate 15 to electromagnet 7 through outside, as shown in FIG. 8B.

This arrangement of the second embodiment similarly ensures the advantages gained by the first embodiment. Since the second embodiment is arranged by employing conventional structural parts so as to form the magnetic circuit without providing side walls 22 and 23, it becomes possible to ensure the above mentioned advantages without newly employing parts and increasing the size of the system.

Figure 9:
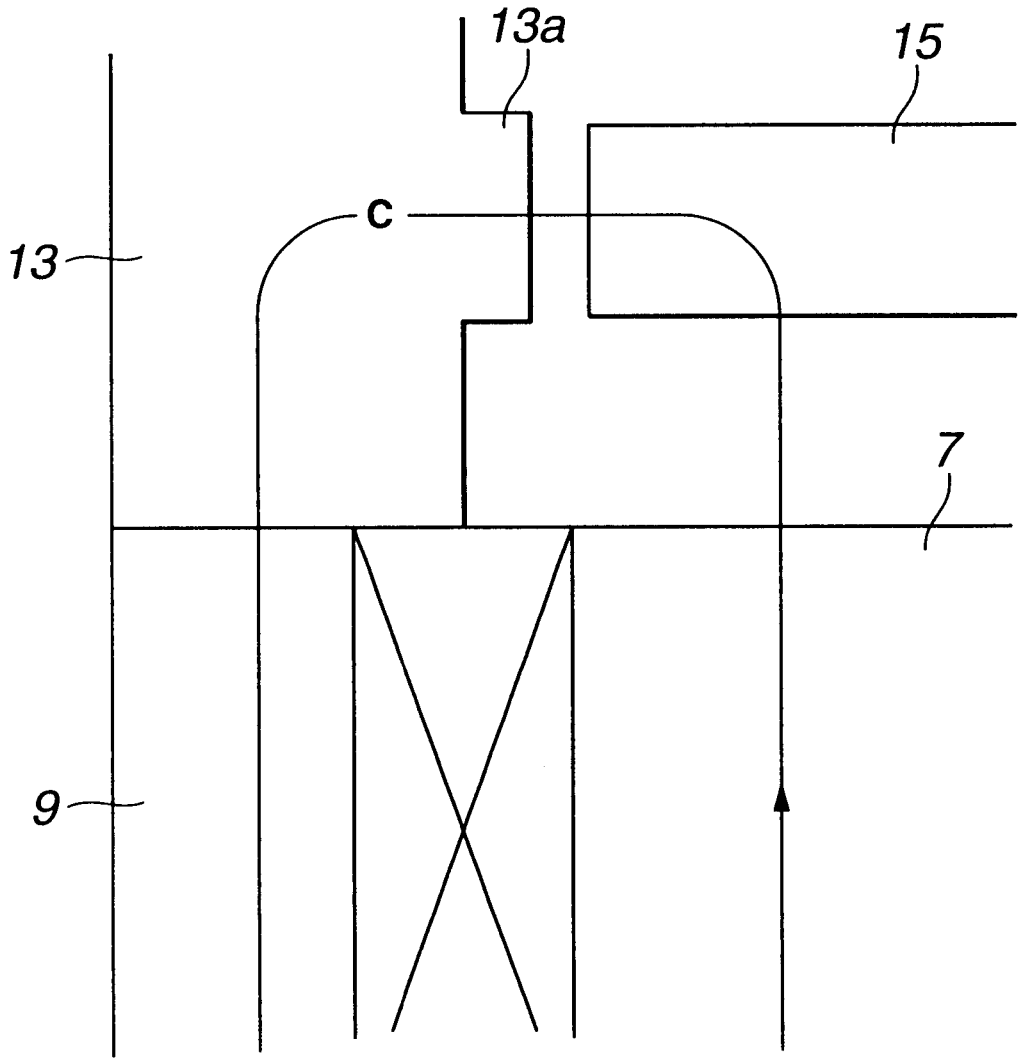
FIG. 9 is an enlarged cross section view showing a distance block employed in a third embodiment according to the present invention.

With reference to FIG. 9, a third embodiment of the engine valve operating system according to the present invention will be discussed hereinafter.

The third embodiment is arranged such that end blocks 9, 10, 11 and 12, and distance blocks 13 and 14 are made of soft magnetic material, which is basically the same as the second embodiment. Further, the third embodiment is particularly arranged such that a projecting portion 13*a*, 14*a* is formed on a surface of distance block 13, 14 faced to movable plate 15 as shown in FIG. 9.

By providing projecting portions 13*a* and 14*a* at surfaces of distance blocks 13 and 14 directed to movable plate 15, the magnetic flux of the magnetic circuit C is concentrated to projecting portions 13*a* and 14*a*. This arrangement improves the attracting force of electromagnet 7, 8 under the large air-gap condition and can decrease the electric energy consumption.

Figure 10:
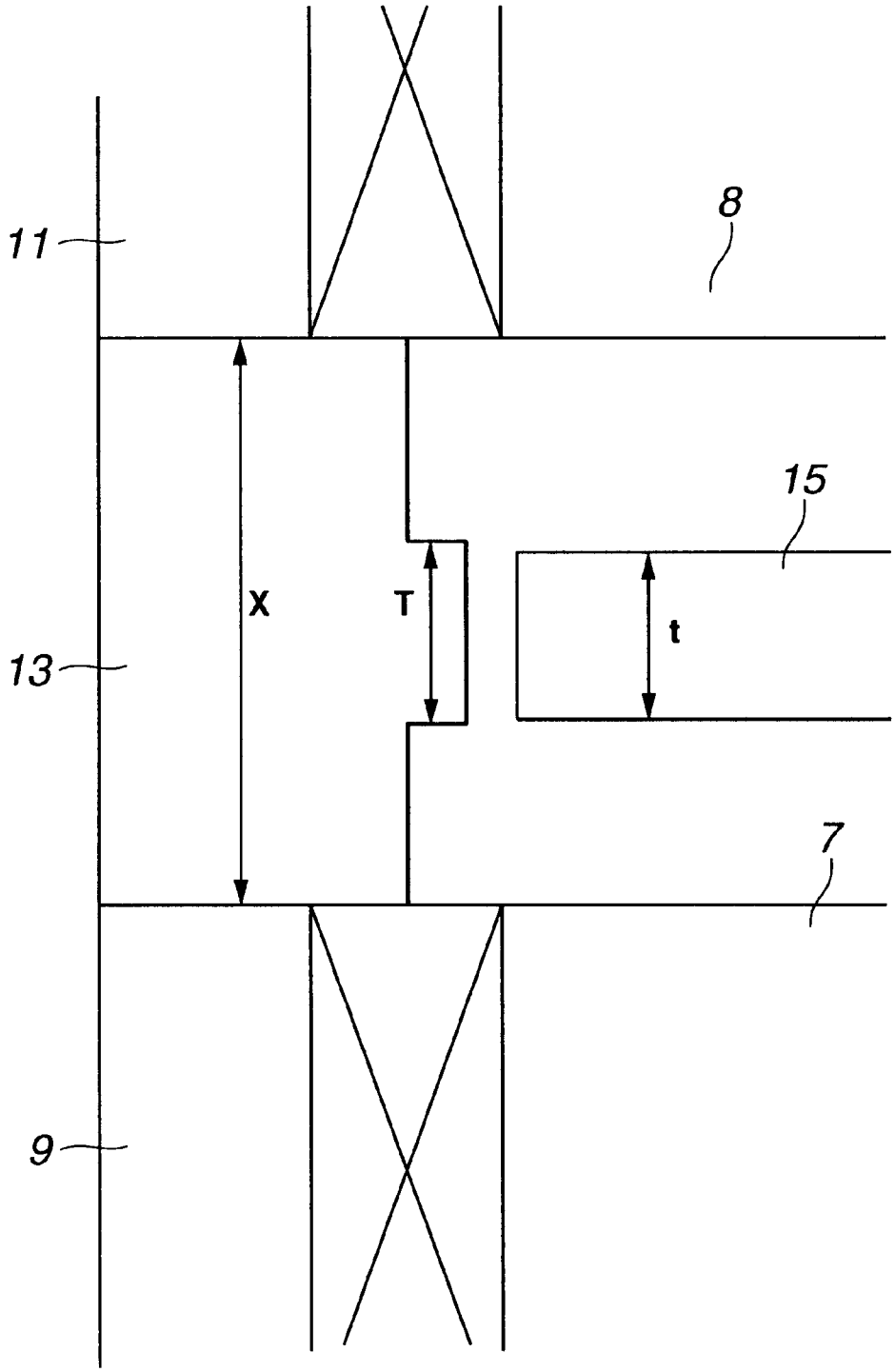
FIG. 10 is an enlarged cross section view showing a relationship between the distance block and the movable plate employed in a fourth embodiment according to the present invention.

With reference to FIG. 10, a fourth embodiment of the engine valve operating system according to the present invention will be discussed hereinafter.

The fourth embodiment is basically the same as the third embodiment shown in FIG. 9. The fourth embodiment is particularly arranged such that projecting portions 13*a* and 14 are located at a center of a vertical dimension C of distance block 13, 14 as shown in FIG. 10. This arrangement enables the attracting forces of respective electromagnets 7 and 8 to be equalized with respect to movable plate 15 when the magnetomotive force is applied thereto. Accordingly, even if the initializing operation is executed to move valve 2 into closed direction or into open direction, the initializing operation is smoothly executed regardless the moved direction of valve 2.

Further, a vertical dimension (width) T of projecting portion 13*a* (14*a*) is determined so as to be greater than a difference between the vertical dimension (thickness) X of distance plate 13 (14) and the vertical dimension (thickness) t of movable plate 15 as represented by the following equation (3).

$$T>X-t \tag{3}$$

By this arrangement, movable plate 15 is always overlapped with projecting portion 13*a*, 14*a* partially. Accordingly, even if movable plate 15 slightly rotates around shaft 16 during when movable plate 15 is moved to operate valve 2, movable plate 15 is never scratched with projecting portions 13*a* and 14*a*. Movable plate 15 smoothly reciprocates in the space between electromagnets 7 and 8.

Figure 11:
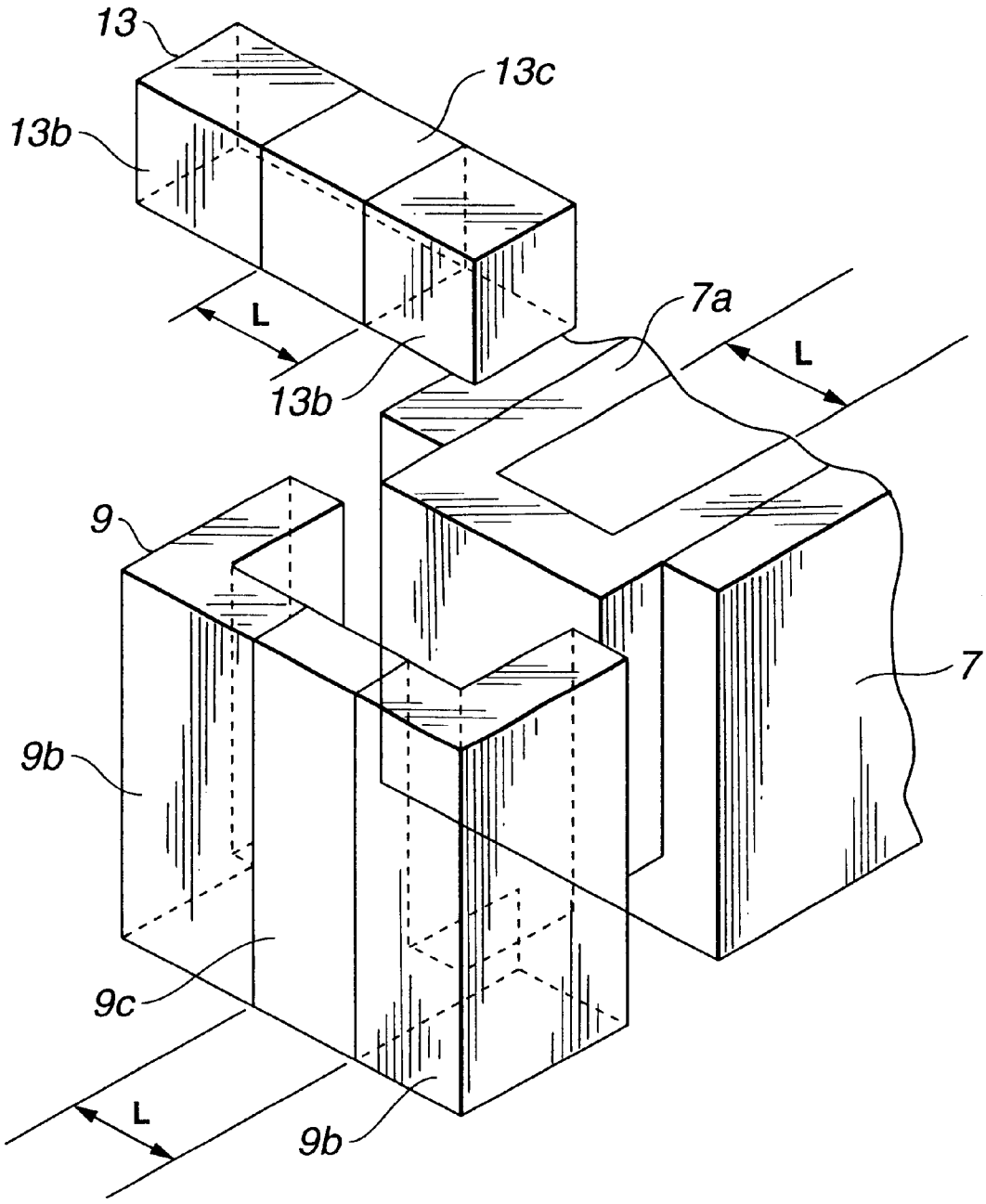
FIG. 11 is an exploded perspective view showing the electromagnet, an end block and the distance block which are employed in a fifth embodiment according to the present invention.

With reference to FIG. 11, a fifth embodiment of the engine valve operating system according to the present invention will be discussed hereinafter.

The fifth embodiment is arranged such that end blocks 9, 10, 11 and 12, and distance blocks 13 and 14 are partially made of soft magnetic material. More specifically, as shown in FIG. 11, only the parts 9*c* and 13*c* of end block 9 and distance block 13 are made of soft magnetic material such as iron. The width of the parts 9*c* and 13*c* corresponds to the width L of inner magnetic pole of electromagnet 7. The other parts 9*b* and 13*b* of end block 9 and distance block 13 are made of non-magnetic material.

In a conventional system, distance block 13 and end block 9 have not been designed so as to circulate the magnetic flux. Rather, they have been generally made of non-magnetic material such as aluminum alloy, nonmagnetic stainless steel so as not to relate the magnetic circuit. Particularly, in order to decrease the mass weight at the top of engine head, they have generally been made of aluminum alloy.

In order to suppress the weight of engine head including the valve operating system, end blocks 9, 10, 11 and 12 and distance blocks 12 and 14 are partially made of soft magnetic material. By partially employing soft magnetic material at the part having the width L as same as the width of inner magnetic pole of electromagnet 7, 8, and by employing non-magnetic material such as aluminum alloy at the other part, the increase of the head weight is suppressed. In these embodiments according to the present invention, the soft magnetic material applicable to the system according to the present invention includes iron (soft iron), Permalloy, iron-nickel alloy and silicon steel.

The entire contents of Japanese Patent Application No. 2000-116966 filed on Apr. 18, 2000 in Japan are incorporated herein by reference.

Although the invention has been described above by reference to certain embodiments of the invention, the invention is not limited to the embodiments described above. Modifications and variations of the embodiment described above will occur to those skilled in the art, in light of the above teaching. The scope of the invention is defined with reference to the following claims.

What is claimed is:

1. An engine valve operating system for an internal combustion engine, comprising:

a movable member interlocking with an engine valve of the engine;

a first electromagnet moving said movable member in a valve opening direction when said first electromagnet is energized;

a second electromagnet moving said movable member in a valve closing direction when said second electromagnet is energized;

a first spring installed to the engine valve, said first spring applying a force directed in the valve opening direction to said movable member;

a second spring installed to said movable member, said second spring applying a force directed in the valve closing direction to said movable member; and a magnetic-circuit member connected to said first electromagnet and said second electromagnet, said magnetic-circuit member being made of soft magnetic material;

wherein said magnetic-circuit member, said movable member and one of said first and second electromagnets form a first magnetic circuit when a clearance between said movable member and the one of said first and second electromagnets is within a far-side range including a distance equal to a half of a stroke of said movable member, the first magnetic circuit passing magnetic flux from said movable member to said magnetic-circuit member, wherein said movable member and the one of said first and second electromagnets form a second magnetic circuit when the clearance between said movable member and the one of said first and second electromagnets is within a near-side range including a smallest distance between said movable member and the one of the said first and second electromagnets.

2. The engine valve operating system as claimed in claim 1, wherein a range of the clearance is smaller than or equal to a half of a stroke of said movable member.

3. The engine valve operating system as claimed in claim 1, wherein said magnetic-circuit member is disposed outside of a moving area in which said movable member reciprocally moves between said first and second electromagnets.

4. The engine valve operating system as claimed in claim 1, wherein said magnetic-circuit member includes a pair of side walls which are installed to side surfaces of said first and second electromagnets while ensuring a predetermined clearance with respect to side surfaces of said movable member.

5. The engine valve operating system as claimed in claim 1, wherein said magnetic-circuit member includes a distance block which is disposed between said first and second electromagnets to form a predetermined clearance between said first and second electromagnets.

6. The engine valve operating system as claimed in claim 5, wherein said movable member is in a form of a rectangular plate whose main surfaces are faced towards said first and second electromagnets, and two opposite side surfaces of said movable plate are faced towards two distance blocks, respectively.

7. The engine valve operating system as claimed in claim 5, wherein the distance block has a pair of projecting portions which are formed on the distance block so as to face said movable member.

8. The engine valve operating system as claimed in claim 7, wherein a vertical dimension of the projecting portion is set to be greater than a difference between a vertical dimension of a distance plate and a vertical dimension of said movable plate.

9. The engine valve operating system as claimed in claim 1, wherein the soft magnetic material includes iron, Permalloy, iron-nickel alloy and silicon steel.

10. The engine valve operating system as claimed in claim 1, wherein each of said first and second electromagnets comprises an electromagnetic core and a pair of end blocks connected to the electromagnetic core.

11. The engine valve operating system as claimed in claim 10, wherein the end blocks and a distance block disposed between said first and second electromagnets are partially made of soft magnetic material such that the parts made of soft magnetic material have a width corresponding to a width of an inner magnetic pole of one of said electromagnets, and the other parts of the end blocks and the distance block are made of non-magnetic material.

12. The engine valve operating system as claimed in claim 1, wherein a clearance between said movable member and said magnetic-circuit member is smaller than a half of a stroke of said movable member.

13. An engine valve operating system for an internal combustion engine, comprising:

a movable member interlocking with an engine valve of the engine;

a first electromagnet moving said movable member in a valve opening direction when said first electromagnet is energized;

a second electromagnet moving said movable member in a valve closing direction when said second electromagnet is energized;

a first spring installed to the engine valve, said first spring applying a force directed in the valve opening direction to said movable member;

a second spring installed to said movable member, said second spring applying a force directed in the valve closing direction to said movable member; and a magnetic-circuit member connected to said first electromagnet and said second electromagnet, said magnetic-circuit member being made of soft magnetic material, said magnetic-circuit member and one of said first and second electromagnets forming a magnetic circuit when a clearance between said movable member and the one of said first and second electromagnets is within a predetermined range, the magnetic circuit passing magnetic flux from said movable member to said magnetic-circuit member, wherein said magnetic-circuit member includes a distance block which is disposed between said first and second electromagnets to form a predetermined clearance between said first and second electromagnets, wherein said movable member is in a form of a rectangular plate whose main surfaces are faced to said first and second electromagnets, and two opposite side surfaces of said movable plate are faced to two distance blocks, respectively, and wherein the two distance blocks are arranged on a plane perpendicular to an axis of a crankshaft of the engine when the engine valve operating system is equipped on the engine.

14. An engine valve operating system for an internal combustion engine, comprising:

a movable member comprising a movable plate and a shaft whose end is integrally connected to the movable plate, the other end of the shaft being in contact with a top end of an engine valve;

a first electromagnet fixed to a cylinder head of the engine, the shaft of said movable member slidably penetrating said first electromagnet in a direction perpendicular to an axis of a crankshaft of the engine, said first electromagnet moving said movable member in a valve opening direction when said first electromagnet is energized;

a second electromagnet fixed on said first electromagnet through a pair of distance blocks to form a predetermined clearance between said first and second electromagnets, said second electromagnet moving said movable member in a valve closing direction when said second electromagnet is energized;

a first spring installed to the engine valve, said first spring applying a force directed in the valve opening direction to said movable member;

a second spring installed to said movable member, said second spring applying a force directed in the valve closing direction to said movable member, the force of said second spring being balanced with the force of said first spring when said movable member is located at a neutral position between said first and second electromagnets and when said first and second electromagnets are deenergized; and a fixing member connected to said first electromagnet and said second electromagnet, said fixing member being located outside of said movable member while having a predetermined clearance with respect to said movable member, said fixing member being made of soft magnetic material, said fixing member and one of said first and second electromagnets forming a first magnetic circuit when a clearance between said movable member and one of said first and second electromagnets is within a far-side range including a distance equal to a half of a full stroke of said movable member, the first magnetic circuit passing magnetic flux from said movable member to said fixing member, wherein said movable member and the one of said first and second electromagnets form a second magnetic circuit when the clearance between said movable member and the one of said first and second electromagnets is within a near-side range including a smallest distance between said movable member and the one of the said first and second electromagnets.

15. An engine valve operating system for an internal combustion engine, comprising:

valve interlocking means for interlocking with an engine valve of the engine;

opening force generating means for moving valve interlocking means in a valve opening direction when said opening force generating means is energized;

closing force generating means for moving said valve interlocking means in a valve closing direction when said closing force generating means is energized;

first biasing means for applying a force directed in the valve opening direction to said valve interlocking means;

second biasing means for applying a force directed in the valve closing direction to said valve interlocking means; and magnetic-circuit means for forming a first magnetic circuit of passing magnetic flux from said valve interlocking means to said magnetic-circuit means in conjunction with said interlocking means and one of said opening force generating means and said closing force generating means when a clearance between said interlocking means and the one of said opening force generating means and said closing force generating means is within a far-side range, wherein said magnetic-circuit means and the one of said opening force generating means and closing force generating means form a second magnetic circuit when the clearance between said magnetic-circuit means and the one of said opening force generating means and closing force generating means is within a near-side range including a smallest distance between said valve interlocking means and the one of the said opening force generating means and closing force generating means.

* * * * *